United States Patent [19]

Sudekum

[11] 4,207,196

[45] Jun. 10, 1980

[54] STABILIZED COMPOSITIONS OF POLYMERS IN OIL

[75] Inventor: John H. Sudekum, Northfield, Ohio

[73] Assignee: The B F Goodrich Company, Akron, Ohio

[21] Appl. No.: 967,445

[22] Filed: Dec. 7, 1978

[51] Int. Cl.[2] ..... C10M 1/32; C10M 1/38

[52] U.S. Cl. ..... 252/47.5; 252/47; 252/402

[58] Field of Search ..... 252/47, 47.5, 402

[56] References Cited

U.S. PATENT DOCUMENTS

| | | | |
|---|---|---|---|
| 2,412,903 | 12/1946 | Miller et al. | 252/47 X |
| 3,249,542 | 5/1966 | Barry | 252/47.5 |
| 3,389,087 | 6/1968 | Kresge et al. | 252/59 |
| 3,412,026 | 11/1968 | Booher | 252/47.5 X |

*Primary Examiner*—W. J. Shine

*Attorney, Agent, or Firm*—J. Hughes Powell, Jr.

[57] ABSTRACT

Ethylene/α-olefin polymers dissolved in mineral base oils as lubricating oils and functional fluids that are subject to excessive temperatures and agitation have improved resistance to degradation of the polymer and decrease in viscosity when such compositions contain certain dialkyl dithiocarbamate salts and certain tetraalkyl thiuram sulfides.

6 Claims, No Drawings

STABILIZED COMPOSITIONS OF POLYMERS IN OIL

BACKGROUND OF THE INVENTION

Mineral lubricating oils and other functional fluids have a tendency to become thin and lose lubricating properties at elevated temperatures, and thicken at low temperatures, thus causing undesirable friction and drag on moving parts. The art has found it generally necessary to incorporate additives to improve the viscosity-temperature coefficient of lubricating oils. A useful class of such additives to improve the lubricating compositions with respect to viscosity index, while maintaining thickening properties and shear stability, are the ethylene/α-olefin polymers. Since representative patents disclosing such applications include the following U.S. Pat. Nos.: 3,389,087; 3,507,636; 3,522,180; 3,551,336; 3,563,964; 3,598,738. These copolymer materials, as well as polymers containing additional olefin and diolefin comonomers, have found extensive use in these applications. In the processing of these ethylene/α-olefin polymers in lubricating oils and the like, the polymers dissolved in the oil are often exposed to excessive temperatures for long periods of time, often in the presence of oxygen or air and agitation, which may result in a loss of desirable physical properties of the polymers for use as viscosity additives for lubricating oils, or in subsequent uses. Stabilized compositions having improved resistance to the effect of heat and air or oxygen are desired.

SUMMARY OF THE INVENTION

Ethylene/α-olefin polymers dissolved in mineral base oils as lubricating oils that are subject to excessive temperatures and agitation have improved resistance to degradation of the polymer and decrease in viscosity when such compositions contain certain dialkyl dithiocarbamate salts and certain tetraalkyl thiuram sulfides.

DETAILED DESCRIPTION

The ethylene-higher α-olefin (EPDM) polymers employed have an ethylene content of from about 10% to about 90% by weight, a higher α-olefin content of about 10% to about 80% by weight, and a polyene content of about 0 to about 20% by weight, all weights based on the total weight of the polymer. The higher α-olefins contain 3 to about 14 carbon atoms. Examples of these are propylene, isobutylene, 1-butene, 1-pentene, 1-octene, 2-ethyl-1-hexene, 1-dodecene, and the like. The polyene can be a conjugated diene such as isoprene, butadiene, chloroprene, and the like; a nonconjugated diene; a triene, or a higher polyene. Examples are 1,4-hexadiene, 1,5-hexadiene, 2,5-dimethyl-1,5-hexadiene, 1,4-octadiene, and the like; cyclic dienes such as cyclopentadiene, cyclohexadiene, cyclooctadiene, dicyclopentadiene, and the like; vinyl cyclic enes such as 1-vinyl-1-cyclopentene, 1-vinyl-1-cyclohexene, and the like; alkylbicyclonondienes such as 3-methylbicyclo(4,2,1)nona-3,7-diene, 3-ethyl-bicyclonondiene, and the like; indenes such as methyl tetrahydroindene, and the like; alkenyl norbornenes such as 5-ethylidene-2-norbornene, 5-butylidene-2-norbornene, 2-methallyl-5-norbornene, 2-isopropenyl-5-norbornene, 5-(1,5-hexadienyl)-2-norbornene, 5-(3,7-octadienyl)-2-norbornene, and the like; and tricyclo dienes such as 3-methyltricyclo-(5,2,1,$0^{2,6}$)-3,8-decadiene, and the like. The more preferred dienes are the nonconjugated diene monomers containing from 5 to about 25 carbon atoms. Alkenyl norbornenes, cyclopentadiene and 1,4-hexadiene have been used as the diene comonomer. The EP and EPDM polymers are readily prepared using polymerization techniques known to the art such as described in U.S. Pat. No. 3,646,169.

Preferredly, the EPDM polymers may contain from about 20% to about 80% by weight of ethylene, about 19% to about 70% by weight of a higher α-olefin, and about 0 to about 20% by weight of a non-conjugated diene. The more preferred higher α-olefins are propylene and 1-butene. The EPDM polymers normally have an ethylene content of from about 40% to about 70% by weight, a propylene content of from about 20% to about 49% by weight, and a non-conjugated diene content from above 0, as about 1% to about 10% by weight, all weights based upon the total weight of the polymer.

The EPDM polymers have molecular weights from about 20,000 to about 2,000,000 or more. Their physical form varies from waxy materials to soft rubbers to tough hard polymers. They have dilute solution viscosities (DSV) from about 0.5 to about 10, measured to 30° C. on a solution of 0.1 gram of polymer in toluene.

The base oil used in the improved process of this invention may be lubricating oils or functional fluids such as automotive transmission fluids and hydraulic fluids. Lubricating oils such as the normally used crankcase oils are derived from paraffinic, naphthenic or asphaltic crudes or mixtures thereof. Such materials are normally considered to be non-volatile mineral oils which have been refined to remove acidic and alkaline impurities. Lubricating based oils normally are paraffinic solvent refined oils having Saybolt Universal Seconds (S.U.S.) viscosity of about 60 to 220 at 100° F., and viscosity indices of about 80 to 110. Hydraulic fluid oils are predominately naphthenic and have S.U.S. viscosity not greater than about 50. The ethylene polymers described herein are added to these materials as viscosity index improvers and the defined dialkyl dithiocarbamate salts and tetraalkyl thiuram sulfides are added to provide improved stability to the polymers in the oils, which normally are adversely effected by air, high temperature and severe agitation.

The additives found use as stabilizers for the ethylene α-olefin polymer lubricant composition include both salts of alkyl dithiocarbamates and alkyl thiuram sulfides. Particularly useful are the alkali metal salts of dialkyl dithiocarbamates of group IA and selenium and tellurium salts of group VIA of the periodic chart of the elements. Typical materials include sodium dimethyl dithiocarbamate, selenium dimethyl dithiocarbamate, potassium dimethyldithiocarbamate, sodium diethyl dithiocarbamate, potassium diethyl dithiocarbamate, selenium diethyl dithiocarbamate, tellurium diethyl dithiocarbamate, selenium dibutyl dithiocarbamate, potassium pentamethylene dithiocarbamate, sodium cyclohexylethyl dithiocarbamate, mixtures and the like. The alkyl group may contain 1 to 8 carbon atoms, preferably 1 to 6 carbon atoms, for example, 1 to 2 carbon atoms.

The preferred tetraalkyl thiuram sulfides include tetramethylthiuram monosulfide, tetramethylthiuram disulfide, tetraethylthiuram monosodium, tetraethylthiuram disodium, tetrabutylthiuram monosulfide, dipentamethylenethiuram disulfide, mixtures thereof and the like. The alkyl group may contain 1 to 8 carbon atoms, preferably 1 to 6 carbon atoms.

The amounts of the dialkyl dithiocarbamate salt or alkyl thiuram sulfide may vary from small amounts which are just effective to improve the stability of the olefinic/polymer oil mixture, preferably greater than about 0.1 weight percent based on the weight of the polymer up to about 5 or more weight percent. Larger amounts normally are not necessary or desirable.

In order to demonstrate the effectiveness of the composition of this invention, a reactor was quipped with an agitator, a heating source and an air bubbling tube. In a sample of Standard 100 SUS oil there was dissolved 7.5 weight percent of an ethylene propylene copolymer containing 56 weight percent ethylene (66 mole percent) which had a Mooney value of ML 1+8 at 100° C. of 45. To separate portions of this oil-olefin polymer mixture there was added 1 weight percent, based on the weight of olefin polymer, of a number of chemical materials including known polymer stabilizers and the resulting compositions were tested as follows: 250 ml of the oil-polymer mixture was weighed, and then there was added an amount of chemical to be tested equivalent to 1 weight percent based on the total polymer content of the oil-polymer mixture. The mixture was then heated to 300° F. with mild agitation and the viscosity measured with a Brookfield Viscometer in centipoises (cps). Air was started bubbling through the agitated oil mixture and after a two hour period the agitation and air addition were stopped, a vacuum was applied to the sample to remove air, the sample was reheated to 300° C. and the viscosity measured. Then air addition was begun for an additional two hour periods and tests continued until the oil broke down.

EXAMPLE I

A Tertiary Butyl Phenol Antioxidant

| | |
|---|---|
| Initial viscosity | 220 cps |
| After 2 hours | 220 cps |
| After 4 hours | 140 cps |
| After 5 hours | 50 cps |

EXAMPLE II 2,6-di-t-butyl-p-cresol

| | Viscosity |
|---|---|
| Initial Viscosity | 220 cps |
| After 2 hours | 190 cps |
| After 4 hours | 130 cps |
| After 6 hours | 130 cps |
| After 8 hours | 110 cps |

EXAMPLE III

With a 50% mixture of 2,6-di-t-butyl-p-cresol and octylated diphenylamines, initial viscosity 220 cps, after only two hours, the viscosity was 30 cps.

EXAMPLE IV

With mercaptobenzothiazole, the initial viscosity was 220 cps. The viscosity after two hours was 30 cps.

EXAMPLE V

Sodium Dimethyl Dithiocarbamate

| Hours | Viscosity |
|---|---|
| 2 | 230 cps |
| 4 | 220 cps |
| 6 | 190 cps |
| 8 | 180 cps |

This represents only an 18% loss in viscosity over an 8 hour period under this severe heating and oxidizing atmosphere. The polymer stabilizer of Example II had a 50% loss in viscosity after an 8 hour period under the same reaction conditions. There was even a greater percentage loss with the mercaptobenzothiazole of Example IV and the known stabilizers of Examples I and III. In I, the sample showed a 77% loss after only 5 hours.

Copper dimethyl dithiocarbamate was unsatisfactory and caused a black discoloration, and bismuth dimethyl dithiocarbamate was insoluble in the oil. When the examples are repeated with (1) tetramethylthiuram disulfide and (2) tellurium diethyl dithiocarbamate, improved resistance to oxidation of the oils is obtained. Zinc dibutyl dithiocarbamate is very soluble in the oil and provides resistance to heat induced air oxidation.

When the ethylene propylene copolymer of the examples is dissolved in 100 SUS oil in amount of 7.5 weight percent concentration the oil has a viscosity of 220 cps at 149° C. (300° F.). In one hour, and in the absence of any additives, using a whirling blender blade at 1500 to 1700 rpms at 149° C. the oil viscosity dropped to only 20 cps.

I claim:

1. An oil composition comprising a mineral base oil, a copolymer of ethylene and an α-olefin and a material selected from the group consisting of a stabilizing amount of a (1) metal salt of alkyl dithiocarbamate in which said metal is alkyl metal of group 1A, selenium or tellurium or (2) an alkyl thiuram sulfide.

2. A composition of claim 1 wherein (2) are tetraalkyl thiuram sulfides.

3. A composition of claim 1 wherein (1) is a sodium salt and the alkyl groups contain 1 to 6 carbon atoms.

4. A composition of claim 2 wherein (2) is a tetraalkyl thiuram sulfide or disulfide and the alkyl group contains 1 to 6 carbon atoms.

5. A composition of claim 3 wherein the copolymer is ethylene and propylene and (1) is present in amounts up to about 5 weight percent based on said copolymer, and the alkyl groups contain 1 to 2 carbon atoms.

6. A composition of claim 4 wherein the copolymer is ethylene and propylene and (2) is present in amounts up to about 5 weight percent based on said copolymer, and the alkyl groups contain 1 to 2 carbon atoms.

* * * * *